United States Patent [19]

Derouin

[11] 4,384,626

[45] May 24, 1983

[54] CLAMP-ON STABILIZER

[75] Inventor: Douglas L. Derouin, Sunset Beach, Calif.

[73] Assignee: Smith International, Inc., Newport Beach, Calif.

[21] Appl. No.: 351,001

[22] Filed: Feb. 22, 1982

[51] Int. Cl.[3] ..... E21B 17/10

[52] U.S. Cl. ..... 175/57; 175/325; 166/241; 308/4 A; 192/79; 192/94

[58] Field of Search ..... 175/57, 325, 323, 73, 175/76; 166/241; 308/4 A; 285/322, 323; 403/371; 192/94, 54, 79

[56] References Cited

U.S. PATENT DOCUMENTS

| | | | |
|---|---|---|---|
| 3,276,824 | 0/0000 | Carter | 308/4 A |
| 3,482,889 | 12/1969 | Cochran | 166/241 |
| 3,642,079 | 0/0000 | Van Note | 175/325 |
| 3,799,277 | 3/1974 | Kellner | 175/325 |
| 3,916,998 | 0/0000 | Bass, Jr. et al. | 166/301 |
| 4,000,549 | 0/0000 | Brumley et al. | 24/263 DB |
| 4,101,179 | 0/0000 | Barron | 308/4 A |
| 4,105,262 | 0/0000 | Richey | 308/4 A |
| 4,131,167 | 0/0000 | Richey | 175/323 |
| 4,258,804 | 0/0000 | Richey et al. | 175/325 |

FOREIGN PATENT DOCUMENTS

| | | | |
|---|---|---|---|
| 653108 | 2/1963 | Italy | 285/323 |

*Primary Examiner*—Ernest R. Purser
*Assistant Examiner*—Thuy M. Bui
*Attorney, Agent, or Firm*—Christie, Parker & Hale

[57] ABSTRACT

A clamp-on stabilizer fixes the lateral position of a drill string in a borehole. The stabilizer includes a gripping sleeve with slotted and tapered ends, a stabilizer body receiving the sleeve, and a tubular locknut threaded into the body. The lower end of the stabilizer body is internally tapered to engage one tapered end of the gripping sleeve, while a ring abutting the locknut engages the other tapered end. In a preferred embodiment the tapers are different at each end of the sleeve to produce a sequential locking effect. A full-length longitudinal slot in the sleeve increases the tolerance range for objects to be clamped by the stabilizer.

69 Claims, 7 Drawing Figures

CLAMP-ON STABILIZER

FIELD OF THE INVENTION

This invention relates to drill string stabilizers, and more particularly to a drill string stabilizer which can be clamped onto any arbitrary round part of the drill string or down-hole drilling apparatus used for drilling oil and gas wells or the like.

BACKGROUND OF THE INVENTION

Drill string stabilizers are tools for resisting lateral loads and lateral movements of the drill collar or drill string in rotary drilling or bore holes in the earth. Certain rock formations and drilling conditions tend to cause the drill bit to deviate from the intended drilling path. Such deviation can be minimized by use of drill string stabilizers. Further, stabilizers properly placed in a drill string for directional drilling can help increase or decrease the bore hole angle as well as maintain a desired hole angle.

Many drill string stabilizers are short pipe sections which are threaded between other parts of the drill string. These cannot always be placed where desired along the length of the drill string and it is desirable to have a stabilizer that can be clamped onto a drill pipe, drill collar or down-hole motor at any location. In addition to permitting stabilization at any desired location, a clamp-on stabilizer can minimize the number of threaded connections in the drill string and each such connection is a site for potential breakage.

When directional drilling with a rotating drill string a near bit stabilizer is commonly positioned immediately above the rock bit and a second string type stabilizer is positioned above a drill collar. The location of the string stabilizer above the rock bit serves a fulcrum which determines whether the hole angle is maintained, increased or decreased. Location is therefore important for obtaining a desired effect. Conventional stabilizers often require and compromise since they are assembled into the drill string between drill collars which are each 30 feet long. Sometimes a short drill collar or pony only ten feet long can be used, but these are not commonly readily available. It is, therefore, desirable to provide a clamp-on stabilizer that can be connected on the outside of the drill collars at any desired location above the rock bit.

Clamp-on stabilizers that have previously been suggested are not satisfactory for field use. Well drilling subjects equipment and tools to very rough handling and sophisticated tools or complicated devices are seldom useful. Prior stabilizers have, for example, required delicate parts or assembly with large numbers of bolts, neither of which is satisfactory on the drill rig floor due to unreliability or great care and time needed for assembly. It is desirable to have a very simple clamp-on stabilizer readily applied on the drill string by the drill rig roughnecks.

Drill strings are subject to becoming out of round due to uneven wearing in the borehole. Such wear can also cause portions of the drill string to wear faster than others, resulting in a variance in outside diameter. Occasionally manufacturing tolerances will permit the outside diameter of the drill string to vary.

Drill string stabilizers that can clamp onto a drill string typically have a small range of tolerance for accepting drill strings of dimensions which vary from the nominal. If the tolerance is exceeded, there is a chance that the stabilizer will not grip the drill string properly and it may be necessary to employ a different tool. It is desirable therefore to provide a stabilizer which has a wide degree of tolerance to accomodate manufacturing differences, uneven wear and out of roundness of a drill string.

It is also desirable to provide a drill string stabilizer which can be made up quickly and positioned at any location on a drill string.

Some prior clamp-on stabilizers have required a breaker or back-up tongs for assembly on the drill string. It is desirable to avoid use of extra tools and provide a clamp-on stabilizer which can be assembled on the drill string using only the set of tongs required for making up the drill string.

It is desirable to provide a clamp-on stabilizer that requires only one location for tightening tongs, thereby minimizing the total length of the stabilizer.

It can also be desirable to provide a clamp-on stabilizer that can be attached to a drill collar that has spiral grooves in its external surface.

Directional drilling with a downhole motor presents special problems for the mineral exploration and production industry. It is often desirable to space a down hole motor from the bottom surface of the non-vertical portion of the hole. Typically, however, such a directional drill motor operates by converting fluid pressure into torque. Such a downhold motor is susceptible to damage if the outside casing is deformed to an out-of-round cross section or is twisted due to differential torque along its length. It is therefore desirable to provide a stabilizer which can be adapted for directional drilling applications and which produces no net torque on a down hole drill motor during operation.

SUMMARY OF THE INVENTION

To satisfy these needs, this invention provides a clamp-on stabilizer comprising a tubular gripping sleeve for gripping around a drill string or the like. The sleeve has an upper end and a lower end each having an inwardly tapered exterior surface. A plurality of longitudinal slots at each end extend from the end toward the center of the sleeve subdividing each end of the sleeve into a plurality of deflectable fingers. A stabilizer body around the sleeve has an upper end and a lower end. The stabilizer body is movable axially relative to the gripping sleeve. Ribs are provided on the stabilizer body for contacting the gage of a borehole. A first internally tapered surface located at the lower end of the stabilizer body and axially fixed relative to the stabilizer body is provided for engaging the lower tapered surface on the outside of the sleeve. A second tapered surface which is axially movable relative to the stabilizer body is provided for engaging the upper tapered surface on the sleeve. Means cooperating with the stabilizer body are provided for axially displacing the second tapered surface toward the first tapered surface, so that, upon such displacement, engagement of the internally tapered surfaces with the corresponding gripping sleeve tapered surfaces causes the deflectable fingers of the gripping sleeve to tighten about the drill string. Preferably the lower taper is steeper than the upper taper for sequential engagement of the tapers as the stabilizer is made up on the drill string.

The invention also provides a method for stabilizing the lateral position of a drill string or the like in a subterranean borehole. The method comprises placing a circumferentially compressible tubular sleeve about the drill string, such sleeve having inwardly tapered upper and lower ends, the taper at the lower end being less than the taper at the upper end, engaging, sequentially, the tapers at the sleeve lower end and the upper end to circumferentially compress the sleeve about the drill string, and displacing the sleeve laterally from the gage of the borehole to stabilize the lateral position of the drill string.

DESCRIPTION OF THE DRAWINGS

These and other features and the advantages of the invention will be more readily understood by reason of the following detailed description when considered in conjunction with the following drawings, wherein.

DETAILED DESCRIPTION

Figure 1:
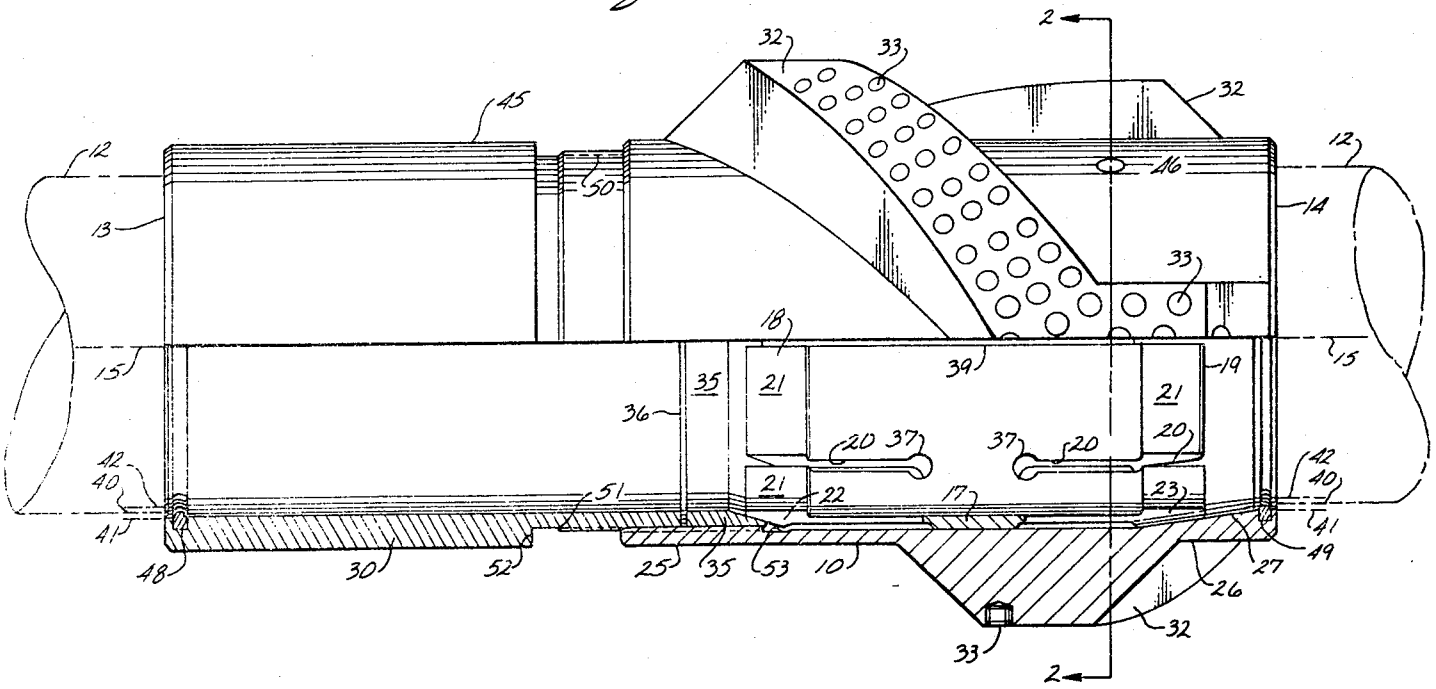
FIG. 1 is a longitudinal view, partly in cross section, of a clamp-on stabilizer constructed according to principles of this invention.

A clamp-on stabilizer has a generally cylindrical tubular steel body 10. The stabilizer is adapted for slip over attachment to a conventional drill pipe 12, shown in phantom lines in FIG. 1.

The drill pipe or string is illustrated as being representative of any object about which the stabilizer may be clamped. Other objects suitable for stabilization by the clamp-on stabilizer of this invention include, for example, spiral or straight drill collars, drill motors and jars, which objects typically are connected in a drill string. The drill string 12 or other object about which the stabilizer is clamped does not form a part of this invention.

The stabilizer has an upper end 13, a lower end 14, and a central axis 15 which is intended to coincide with the central axis of a drill string or other object on which the stabilizer is clamped. As used herein "upper" and "lower" refer only to the two ends of the stabilizer for purposes of identification and are not intended to imply a certain orientation of the stabilizer in use. The drawing of FIG. 1 (and of FIGS. 3, 5 and 7) is divided into two portions on either side of the axis 15. The upper half of the drawing illustrates the exterior features of the clamp-on stabilizer, while the portion below the axis is taken in cross section and illustrates the interior parts of the stabilizer.

A gripping sleeve 17 inside the stabilizer body is generally cylindrical and tubular and has an upper end 18 and a lower end 19. In use the sleeve grips the drill string 12 or other object of interest. At the lower and upper sleeve ends there are, respectively, inwardly tapered exterior surfaces 22 and 23. Each tapered surface has a smaller diameter at the end of the sleeve and a larger diameter nearer the middle of the sleeve. A plurality of longitudinal slots 20 extend from either end of the sleeve toward the middle of the sleeve and divide each end of the sleeve into a series of fingers 21. The fingers can be deflected radially for gripping an object upon application of axial compression against the exterior tapered surfaces. The configuration of the gripping sleeve at each end is somewhat similar to that of a collet.

The stabilizer body 10 surrounds the gripping sleeve and includes an upper end 25 and a lower end 26. An internal tapered surface 27 at the lower end of the stabilizer body engages the external tapered surface 23 at the gripping sleeve lower end. The angles of tapers of the surfaces 23 and 27 match.

The internal tapered surface 27 is fixed axially relative to the lower end of the stabilizer body. It is most convenient to fabricate the tapered surface 27 integrally with the stabilizer body. It will be appreciated, however, that the tapered surface 27 may compise a ring which is secured in place in a suitable recess in the lower end of the stabilizer body.

A series of fins 32 are integrally formed on the outside of the stabilizer body. The fins contact the gage of the borehole and physically space the drill string away from the gage. In an exemplary embodiment the fins are spirally wound around the stabilizer body and include a plurality of tungsten carbide inserts 33 for minimizing erosion of the stabilizer body caused by rotation of the stabilizer clamped on the drill string. Workers skilled in the art will appreciate that the fins 32 may take the form of longitudinal ribs or the like.

The upper end of the stabilizer body is internally threaded and receives an externally threaded end of a tubular locking member or nut 30. The threads and preferably of the stub acme type and progress in the direction of rotation of the drill string during normal drilling. Hence ordinary rotation of the drill string will not induce uncoupling of the locking member from the stabilizer body. A thread relief 53 is provided in the stabilizer body just beyond the end of the threaded portion for ease of manufacture.

The stabilizer also includes a taper or locking ring 35 which has an internally tapered surface which engages the external tapered surface 23 at the sleeve upper end 18. The taper ring is located between the locking member 30 and the stabilizer body 24. The upper end of the locking ring abuts an end surface 36 of the locking member and is movable axially relative to the stabilizer body. The ring is greased and its upper end face can act as a crude bearing against the locking member. If desired in some embodiments, the taper ring 35 can be made integral with the locking member. Preferably the outer surfaces, particularly the bearing end, of the taper ring are induction hardened to increase wear resistance and prolong the useful life of the stabilizer. The tapered ring 35 is sufficiently strong to prevent enlargement of the ring which might cause the ring to lock into the threads in the stabilizer body.

In the stabilizer shown in FIG. 1, the tapered surfaces 22 and 23 at the gripping sleeve lower and upper ends, respectively, are different. The taper at the sleeve lower end is steeper than the taper at the sleeve upper end. That is, the angle of the tapered surface relative to the axis of the stabilizer is smaller at the lower end of the sleeve than at the upper end. Preferably the angle of the taper at the lower end is about one-half the angle of the taper at the upper end. The angle of the smaller taper is greater than the critical locking taper angle of steel on steel. In an exemplary embodiment, the taper angle at the lower end of the gripping sleeve is about 7½ degrees, while the taper angle at the upper end of the sleeve is about 15 degrees.

The different tapers at the opposite ends of the gripping sleeve cause a unique sequential locking effect. To clamp the stabilizer in place about a drill string or the like, the locking member 30 is screwed into the threaded upper end of the stabilizer body which causes the taper ring 35 to be axially displaced toward the lower end of the stabilizer. This produces progressive radial engagement between the four tapered surfaces at the opposite ends of the gripping sleeve, which causes the fingers 21 of the sleeve to deflect inwardly and constrict about the drill string. Accordingly, the four tapered surfaces function to convert axial compression, induced between the ends of the gripping sleeve, into radial compression about the drill string. Progressive threading of the locking member 30 into the stabilizer body eventually causes the tapered surfaces to lock due to frictional effects, at which time the sleeve is gripping the drill string tightly. During this process, the greater tapers at the upper end of the gripping sleeve causes the smaller tapers at the lower end to lock first, followed by eventual locking of the tapers at the upper end of the sleeve. Since the lower end of the stabilizer grips the drill string first, the stabilizer body is prevented from rotating while the locking nut can continue to rotate to more tightly engage the tapered surfaces and complete clamping at the upper end as well.

Figure 2:
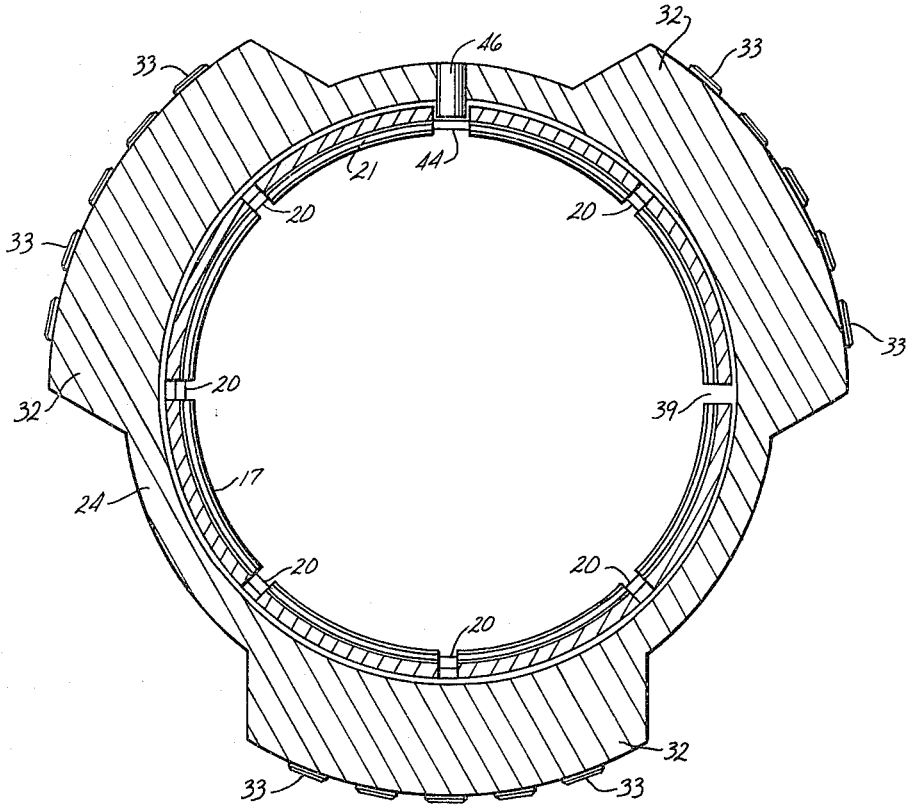
FIG. 2 is a transverse cross section of the clamp-on stabilizer, taken along lines 2—2 of FIG. 1.

Preferably the inner end 37 of each of the longitudinal slots 20 of the gripping sleeve is rounded out to prevent the slots from behaving as a crack and propagating along the sleeve. In the exemplary embodiment of the stabilizer of FIG. 1, there are eight slots evenly spaced about the circumference of the gripping sleeve, as illustrated in FIG. 2. Most of the slots extend only partially along the length of the gripping sleeve. One slot 39 is different from the other slots in that it extends all the way from the sleeve upper end to the lower end. Such a full-length slot enhances the ability of the gripping sleeve to fit tightly about objects which have uneven or out-of-round outside diameters or are appreciably smaller than the nominal size object the stabilizer is designed for.

A tolerance range for the clamp-on stabilizer is indicated by the dashed lines appearing at either end of the locking member in FIG. 1, where the reference line 40 represents a nominal tubing size for the drill string 12, line 41 represents a maximum tubing size, and line 42 represents a minimum tubing size. The range of tolerance in outside diameter or roundness is represented by the distance between the lines 41 and 42. In an exemplary embodiment a tolerance of plus or minus ⅛ inch from a nominal tubing size 40 can be accomodated by the gripping sleeve having a full length slot 39.

The tapered surfaces 23 and 22 at the upper and lower ends of the gripping sleeve match, respectively, the tapers of the taper ring 35 and the tapered surface 27 inside the stabilizer body. Since the tapers are different, it is necessary to assure that the gripping sleeve is oriented correctly in the stabilizer body during makeup of the stabilizer. For this purpose, preferably one partial length slot 44 at the lower end of the gripping sleeve is made about twice as wide as any of the other slots 20 at the upper end of the sleeve, including the full length slot 39. In an exemplary embodiment, the slots 20 and 39 are about ¼ inch wide, while the wider slot 44 is about ½ inch wide. An inwardly extending pin 46 on the stabilizer body is dimensioned to mate with the wide slot 44, but not with any of the narrower slots 20 and 39. Such an arrangement assures quick and correct end-to-end assembly of the stabilizer in the field with matching tapers facing each other.

The threads on the locking member are on a recessed portion 51 which terminates in a shoulder 52. The shoulder is offset a sufficient distance from the upper end of the threads to prevent contact of the upper edge of the stabilizer body with the shoulder when the stabilizer is clamped onto a drilling string having the minimal acceptable tubing dimension 42.

The major components of the clamp-on stabilizer are made from steel tubing, with the exception of the stabilizer body, which is made from a casting or forging.

To make up the stabilizer, the parts are greased. The stabilizer body 10 is fitted over the drill string or other object of interest, and the gripping sleeve 17 is dropped into the body and oriented so that the pin 46 mates with the wide slot 44, typically by rotating the stabilizer body about the drill string. If engagement will not occur, then the gripping sleeve has been inserted upside down, and is reinserted to achieve correct alignment. The taper ring 35 is placed over the gripping sleeve inside the stabilizer body, followed by the locking member 30, which is threaded into the upper end of the stabilizer body. Progressive tightening of the locking member causes the stabilizer to clamp onto the drill string. It will be appreciated that the stabilizer can be made up loosely and moved along a drill string to a desired location.

Makeup of the stabilizer can be started manually or with conventional chain tongs. Tightening of the threads can be completed by conventional hydraulic tongs applied on the tong surface 45 on the locking nut 30. Once the stabilizer begins to make up, the lower end of the gripping sleeve with the smaller taper clamps sufficiently tightly to the drill string so that backup tongs on the stabilizer body are not needed. Accordingly, there is no need to provide space on the stabilizer body for backup tongs. Tong space is needed only on the locking nut and the stabilizer of this invention can be made more compact than conventional stabilizers.

To disengage the stabilizer, it is only necessary to loosen the locking member to release the tapers. If the sleeve sticks in the stabilizer, the fins can be struck by a blunt object, such as a hammer, to unlock the tapers at the lower end.

To discourage drilling chips and other foreign matter from fouling the threaded connection between the locking member and the stabilizer body, the locking member includes a seal ring 48 near its upper edge. The seal ring is preferably fabricated from a metal or an elastomer and is slit to facilitate easy replacement. It is not necessary for the seal ring to form a tight seal around the drill string. If desired a second seal ring 49 can be provided at the lower end of the stabilizer body to minimize entry of foreign material.

Figure 3:
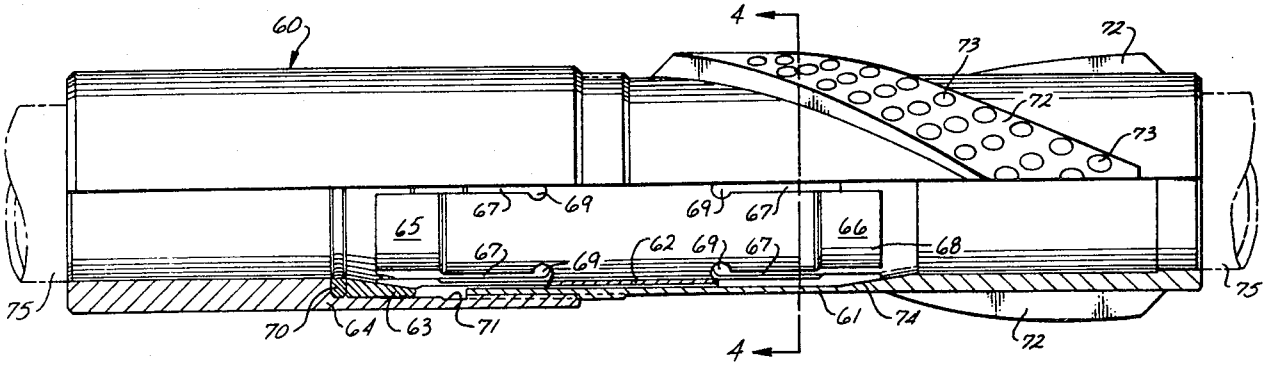
FIG. 3 is a longitudinal view, partly in cross section, of an alternate embodiment of a clamp-on stabilizer.
Figure 4:
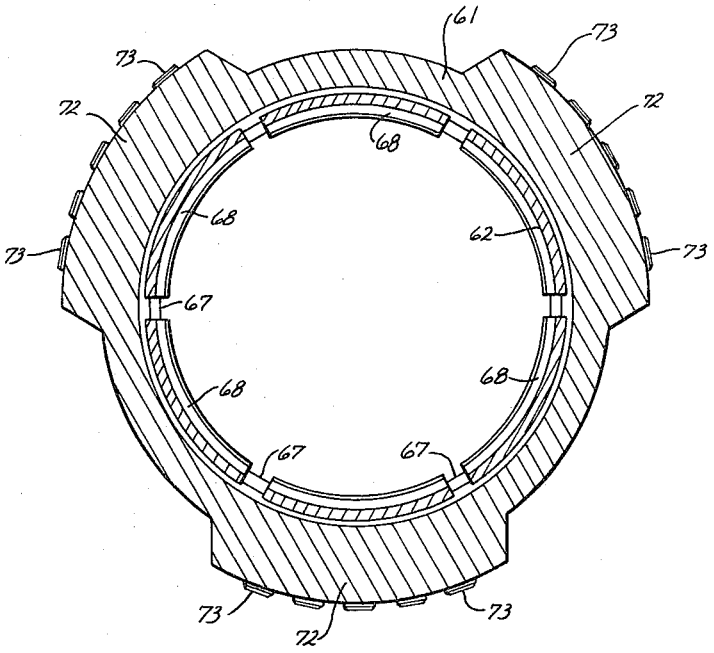
FIG. 4 is a transverse cross section of the alternate embodiment of the clamp-on stabilizer, taken along lines 4—4 of FIG. 3.

An alternate embodiment 60 of a clamp-on stabilizer for smaller diameter applications is illustrated in FIGS. 3 and 4. This stabilizer includes a stabilizer body 61, a gripping sleeve 62, a taper ring 63, and a locking member 64. The lower part of the stabilizer body includes an inwardly tapered surface 74 for engaging the gripping sleeve. The arrangement of these components is somewhat different from the clamp-on stabilizer 10 previously described in connection with FIGS. 1 and 2, one difference being that the tapers are the same at opposite ends of the gripping sleeve.

Another difference in stabilizer 60 lies in the threaded connection between the upper part of the stabilizer body and the locking member. Their roles are reversed from the arrangement in FIG. 1 in that the acme threads are machined onto the outside of the stabilizer body 61 which is now the male component of the threaded connection. The threads on the locking member 64 are on an inside surface of that component so that the locking member is the female member of the threaded connection. The axial location of the threads is somewhat different from the stabilizer of FIG. 1 in that the threads are located between the upper end 65 and the lower end 66 of the gripping sleeve 62. A thread relief 71 is provided for ease of machining the threads in the locking member.

While the gripping sleeve has the collet-type configuration previously discussed with the slots 67 having rounded inner ends 69, and the fingers 68, the tapers at the upper and lower ends are the same. Accordingly, when the stabilizer 60 is made up, both ends of the gripping sleeve lock at about the same time in contrast to the sequential locking described with regard to the embodiment of stabilizer hereinabove described and illustrated in FIGS. 1 and 2. In an exemplary embodiment, both upper and lower tapers of the stabilizer 60 are at an angle of about 15 degrees from the main axis of the gripping sleeve.

The stabilizer 60 preferably includes a wear ring 70 which is located between the locking member 64 and the taper ring 63. The wear ring is preferably fabricated of aluminum bronze to prevent sticking with either the taper ring or the locking member. Accordingly, the wear ring 70 behaves like a bearing between the taper ring 63 and the locking member 64.

The stabilizer 60 includes a series of fins 72 which are located on the outside of the stabilizer body. In an exemplary embodiment the fins 72 are spirally wound around the stabilizer body and include a plurality of tungsten carbide inserts 73 to minimize erosion of the stabilizer fins. The fins function to center the clamp-on stabilizer, and in turn, an object of interest 75, in a borehole.

FIG. 4 is a transverse cross sectional view of a lower end of the stabilizer 60. There are six longitudinal slots 67 evenly distributed around the circumference of the gripping sleeve 62. As the tapers at either end of the gripping sleeve are identical, there is no need to assure correct polarity of the gripping sleeve in the stabilizer body. Accordingly, the gripping sleeve 62 does not include a special wider longitudinal slot at its lower end, nor need a pin be provided on the stabilizer body analogous to the pin 46 of the clamp-on stabilizer of FIGS. 1 and 2.

The stabilizer 60 is intended for use with appropriate objects 75, such as drill motors, which have an exterior surface exhibiting a relatively small degree of nonideality relative to the wide tolerances permitted by the stabilizer 10. Accordingly, the gripping sleeve does not include a full-length longitudinal slot analogous to the slot 39 previously described.

The outside diameter of the locking member 64 is related to the dimensioning of the fins 72 to maintain a roughly uniform fluid pressure distribution along the stabilizer. During normal drilling operations, drilling mud or the like is pumped under pressure through the drill string and floods the borehole. When the fins contact the gage of the borehole, fluid communication in the borehole between the upper and lower ends of the clamp-on stabilizer is possible only through the interstices between the stabilizer fins, and through the volume between the outside of the locking member and the gage of the borehole. The outside diameter of the locking member is selected in cooperation with the fin configuration so that, in taking typical cross sections across the locking member and across the stabilizer body, the annular area between the borehole gage and the locking member outer surface is roughly equal to the cross sectional area between the borehole gage and the stabilizer body in the interstices between the fins. Accordingly, there is approximately the same fluid pressure differential across the stabilizer body as across the locking member.

The stabilizer 60 illustrated in FIGS. 3 and 4 is particularly useful for centering the position of downhole drill motors. As the tapers at both ends of the gripping sleeve lock at about the same time, there is a uniform circumferential pressure distribution on the motor 75, so that the risk of deforming a drum motor casing is reduced to acceptable limits. Moreover, as the tapers lock up simultaneously, no net torque is produced between the ends of the gripping sleeve and consequently no torque is produced on the motor, which might otherwise interfere with its operation.

Figure 5:
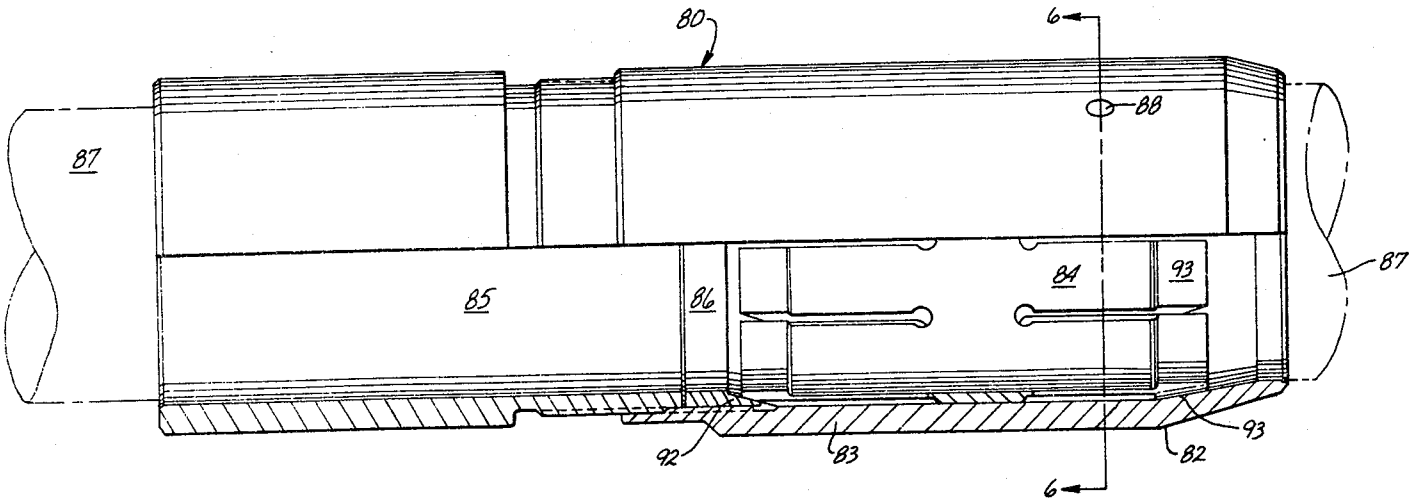
FIG. 5 is a longitudinal view, partly in cross section, of an embodiment of a clamp-on stabilizer useful for directional drilling.
Figure 6:
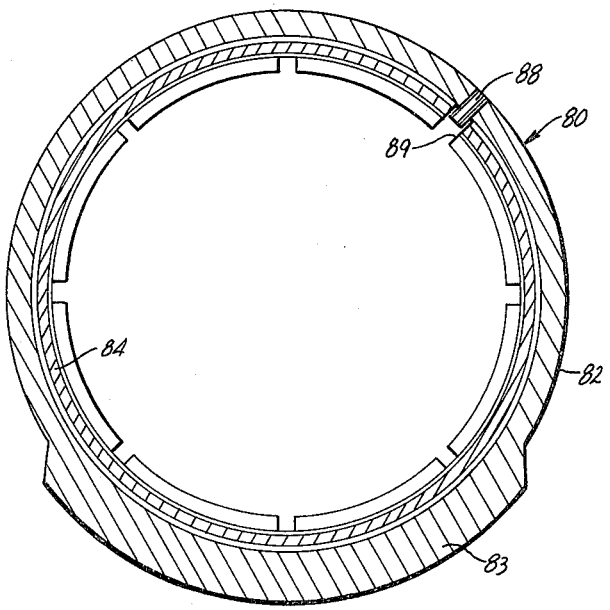
FIG. 6 is a transverse cross section of the clamp-on stabilizer taken along lines 6—6 of FIG. 5.

A third embodiment 80 of a clamp-on stabilizer is illustrated in FIGS. 5 and 6 and includes a stabilizer body 82, a gripping sleeve 83, a locking member 85, and a taper ring 86. A pin 88 and a wide slot 89 assure correct alignment of the gripping sleeve. The arrangement of these components is identical to the clamp-on stabilizer described with reference to FIGS. 1 and 2, except for the configuration of fins on the stabilizer body 82. In the third embodiment 80, in place of three spirally wound fins around the circumference of the stabilizer body, there is provided a single support pad 83 along but one side of the stabilizer body. In FIG. 6, the support pad is shown occupying about ⅓ of the circumferential surface of the stabilizer body. The support pad preferably extends along most of the length of the stabilizer body. The embodiment 80 is particularly useful for directional drilling applications, where the pad is positioned to sit along the bottom surface of a non-vertical portion of the borehole. Accordingly, an object of interest 87 illustrated in dotted lines in FIG. 5 typically represents a down-hole drill motor, although it can represent other objects as well.

The stabilizer body 82 does not rotate in use, and there is no need to introduce tungsten carbide inserts on the outer surface of the drilling pad to minimize erosion, as was done with the stabilizer fins 32 and 72 described previously, where it is contemplated that the stabilizer body would rotate somewhat in use. Although the support pad 83 is described with reference to a stabilizer of the type shown in FIGS. 1 and 2, where the tapers at the end of the gripping sleeve are different, it will be appreciated that such a directional support pad can be used with the stabilizer described in connection with FIGS. 3 and 4 where the tapers are the same at either end of the gripping sleeve.

Figure 7:
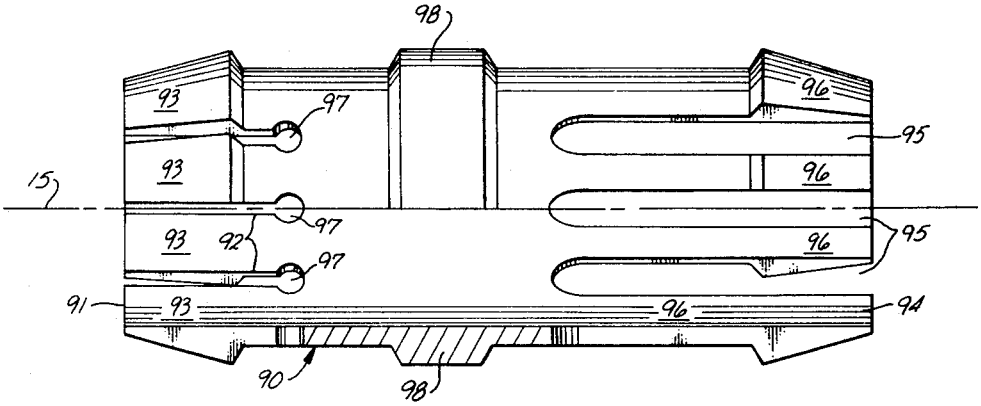
FIG. 7 is a longitudinal view of an alternate embodiment of a gripping sleeve for the clamp-on stabilizer of FIG. 1 or FIG. 3.

FIG. 7 is an alternate embodiment of a gripping sleeve 90 which can be used in stabilizers where it is desired to employ a sequential locking effect as described above in connection with FIG. 1. The sleeve has an upper end 91 which includes a plurality of slots 92 and radially deflectable fingers 93 which have externally tapered outer end surfaces. The sleeve also has a lower end 94 including slots 95 and radially deflectable fingers 96. The fingers 93 and 96 each have externally tapered end surfaces which have the same taper. The sleeve includes a wide middle section 98 for contacting the inner wall of a stabilizer body.

The fingers 96 at the lower end of the sleeve are more readily radially deflected than the fingers 93 at the upper end of the sleeve. This effect is most simply accomplished by extending the slots 95 at the lower end into the sleeve to make the fingers 96 at the lower end larger than the fingers 93 at the upper end, or by widening the lower slots 95 to narrow the lower fingers 96, or both. By making the slots 95 at the lower end wider than the slots 92 at the upper end, the gripping sleeve will readily accomodate an alignment pin 46 from the stabilizer body. A convenient slot width is illustrated in FIG. 7, where the slots 95 are about as wide as the rounded out portion 97 of slot 92. The inner end of such lower slots 95 is sufficiently rounded so that it is unnecessary to further round out the slot to hinder cracking of the gripping sleeve. If desired, the lower fingers 96 may be made thinner in cross section than the upper fingers 93, but this is more difficult to machine.

A gripping sleeve 90 having fingers of differing length or width (or both) may be used in a clamp on stabilizer of the type described in FIG. 1, if the taper angle of the taper ring 35 is made identical with the taper angle of the tapered surface 27 at the lower end of the stabilizer body.

Workers skilled in the art to which this invention pertains will appreciate that the description set forth above is in the context of a presently preferred embodiment to the invention, from which other embodiments consistant with the spirit of the description may differ. For example, the surfaces in the lower end of the stabilizer body and in the locking ring that engage the tapers on the gripping sleeve can each be in the form of part of a torus for engaging the respective taper more or less along a line instead of over a larger tapered area. As used herein "tapered surface" includes such a variation. Other variations will be apparent. Accordingly, the description is not intended as an exhaustive catalog of all possible embodiments which this invention may take. Rather the description is intended as illustrative and exemplary and the claims are presented in that spirit.

What is claimed is:

1. A clamp-on stabilizer for clamping over a section of drill string or the like and spacing such section away from the side wall of a subterranean borehole, the stabilizer comprising:

a tubular gripping sleeve for gripping around the drill string, the sleeve having an upper end and a lower end each having an inwardly tapered exterior surface, and a plurality of longitudinal slots at each end extending from the respective end toward the middle of the sleeve;

a stabilizer body around the sleeve comprising rib means for contacting the gage of the borehole, a threaded upper end, and an internally tapered lower end for engaging the sleeve lower end;

a tubular member threaded for coupling with the stabilizer body threaded upper end; and tapered means for engaging the tapered upper end surface of the gripping sleeve in response to axial compression induced between the member and the stabilizer body upper end, whereby the gripping sleeve is tightened about the object of interest.

2. A stabilizer according to claim 1 wherein the taper at the gripping sleeve upper end surface is steeper than the taper at the gripping sleeve lower end surface.

3. A stabilizer according to claim 2 wherein the angle of the taper at the lower surface is about one half the angle of the taper at the upper surface relative to the axis of the stabilizer.

4. A stabilizer according to claim 3 wherein the taper at the lower surface defines an angle of about 7½ degrees with the axis of the tubular gripping sleeve, and the taper at the upper surface defines an angle of about 15 degrees with said axis.

5. A stabilizer according to claim 1 comprising one full length longitudinal slot in the gripping sleeve from its upper end to its lower end.

6. A stabilizer according to claim 1 wherein the tapered means comprises a ring having an internal taper matching the taper at the sleeve upper end.

7. A stabilizer according to claim 1 wherein the stabilizer body upper end is threaded on an interior surface and the tubular member is threaded on an exterior surface.

8. A stabilizer according to claim 1 wherein the taper at the gripping sleeve lower end surface is substantially the same as the taper at the sleeve upper end surface.

9. A stabilizer according to claim 8 wherein the stabilizer body upper end is threaded on an exterior surface and the tubular member is threaded on an interior surface.

10. A stabilizer according to claim 9 wherein the threaded upper end of the stabilizer body is positioned axially between the ends of the gripping sleeve.

11. A stabilizer according to claim 10 wherein the tapered means comprises a ring having a taper matching the taper of the sleeve upper end, such ring being positioned axially above the stabilizer body upper end.

12. A stabilizer according to claim 13 wherein a first annular area defined between an exterior surface of the tubular member and the gage of the borehole is substantially equal to a second area defined between the gage and an exterior surface of the stabilizer body between the rib means for maintaining a roughly uniform fluid pressure distribution in drilling fluid in the borehole.

13. A stabilizer according to claim 1 wherein the rib means comprises a pad which extends partially around the circumference of the borehole.

14. A stabilizer according to claim 1 wherein at least one of the slots at the lower end of the sleeve is wider than any of the slots at the upper end, and further comprising pin means on the stabilizer body near its lower end for engaging such a wider slot, the pin means being wider than the slots at the upper end of the sleeve to prevent engagement therewith.

15. A clamp-on stabilizer for fixing the lateral position in a subterranean borehole of a drill string or an object of interest on the drill string, the stabilizer comprising:

a tubular gripping sleeve for gripping around the drill string or object of interest, the sleeve having an upper end and a lower end each having an inwardly tapered exterior surface, and a plurality of longitudinal slots at each end extending from the respective end toward the middle of the sleeve, the taper at the lower end being less than the taper at the upper end;

a stabilizer body around the sleeve comprising a tubular body having a threaded upper end, and a lower end internally tapered for engaging the tapered lower end of the sleeve;

rib means on the body for contacting the gage of such a borehole;

a tubular member threaded for coupling with the stabilizer body threaded upper end; and tapered means for engaging the tapered upper end surface of the gripping sleeve;

whereby, in response to axial compression induced by threading the tubular member with the stabilizer body upper end, the tapered lower end of the gripping sleeve locks with the tapered stabilizer body lower end, followed by locking of the tapered upper end of the gripping sleeve with the tapered means, whereby such a drill string or object of interest is gripped by the gripping sleeve to fix its lateral position via the rib means.

16. A stabilizer according to claim 15 wherein the taper at the lower end surface is about one half the taper at the upper end surface.

17. A stabilizer according to claim 15 wherein the taper at the lower end surface is at an angle of about 7 ½ degrees from the axis of the tubular gripping sleeve, and the taper at the upper surface is at an angle of about 15 degrees from said axis.

18. A stabilizer according to claim 15 comprising one full length longitudinal slot in the gripping sleeve from its upper end to its lower end.

19. A stabilizer according to claim 15 wherein the tapered means comprises a ring having an external taper matching the taper at the sleeve upper end.

20. A stabilizer according to claim 15 wherein the stabilizer body upper end is threaded on an interior surface thereof and the tubular member is threaded on an exterior surface.

21. A stabilizer according to claim 20 further comprising seal means inside the tubular member at its upper end for inhibiting particles from entering an annulus between the tubular member and such a drill string or object of interest.

22. A stabilizer according to claim 15 wherein at least one of the slots at the lower end of the sleeve is wider than any of the slots at the upper end of the sleeve, and further comprising pin means on the stabilizer body near its lower end for engaging such a wider slot, said pin means being wider than the slots at the upper end of the sleeve to prevent engagement therewith.

23. A clamp-on stabilizer comprising:

a tubular gripping sleeve for gripping around an object of interest, the sleeve having an upper end and a lower end each having an inwardly tapered exterior surface, and a plurality of longitudinal slots at each end extending from the end toward the middle of the sleeve;

a stabilizer body around the sleeve comprising a threaded upper end, and an internally tapered lower end for engaging the tapered surface at the lower end of the sleeve;

means on the stabilizer body for contacting the gage of a borehole;

a tubular member threaded for coupling with the threaded upper end of the stabilizer body;

a ring located between the tubular member and the upper end of the gripping sleeve, the ring being internally tapered to engage the tapered surface at the upper end of the sleeve; and the tapered at the lower end surface of the gripping sleeve being less than the taper at the upper end surface of the gripping sleeve.

24. A stabilizer according to claim 23 wherein the taper at the lower surface is about one half the taper at the upper surface.

25. A stabilizer according to claim 23 comprising one full-length longitudinal slot in the gripping sleeve from its upper to its lower end.

26. A stabilizer according to claim 23 wherein the stabilizer body upper end is threaded on an interior surface thereof.

27. A stabilizer according to claim 23 wherein the ring contacts the threaded surface of the stabilizer body.

28. A stabilizer according to claim 23 wherein the stabilizer body upper end is threaded on an exterior surface thereof.

29. A stabilizer according to claim 28 wherein the ring is positioned axially above the stabilizer body upper end.

30. A clamp-on stabilizer comprising:

tubular collet means for gripping around an object of interest, the collet means having an upper end and a lower end, each end having a plurality of radially deflectable gripping fingers and an inwardly tapered exterior surface on the fingers;

a longitudinal slot extending the full length of the collet means;

a stabilizer body around the collet means having a threaded upper end, and an internally tapered lower end for engaging the tapered surface on the lower end of the collet means;

rib means on the stabilizer body for contacting the gage of a borehole;

a tubular member threaded for coupling with the stabilizer body threaded upper end; and tapered means for engaging the tapered surface on the upper end of the collet means, whereby threading the tubular member with the stabilizer body induces progressive axial compression against the ends of the collet means for engaging tapered surfaces on the collet means with the tapered lower end of the stabilizer body and the tapered means for gripping the collet means around the object of interest.

31. A stabilizer according to claim 30 where the taper at the lower end of the collet means differs from the taper at the upper end of the collet means.

32. A stabilizer according to claim 31 where the taper at the lower end of the collet means is less than the taper at the upper end of the collet means.

33. A stabilizer according to claim 30 where the tapered means comprises a ring seated against the tubular member and having an internally tapered surface.

34. A clamp-on stabilizer comprising:

a stabilizer body having a threaded upper end and an internally tapered lower end;

a tubular gripping sleeve in the stabilizer body comprising:

a plurality of fingers extending longitudinally at the lower end of the sleeve;

a first tapered surface on the exterior of the fingers at the lower end of the sleeve matching the taper in the lower end of the stabilizer body;

a plurality of fingers extending longitudinally at the upper end of the sleeve;

a second tapered surface on the exterior of the fingers at the upper end of the sleeve; and a slot in the gripping sleeve extending from the upper end of the sleeve to the lower end of the sleeve;

a ring having an internal tapered surface matching the second taper surface at the upper end of the sleeve; and a locking member having a threaded lower end for coupling with the threaded upper end of the stabilizer body and including a surface for engaging the ring and pressing the ring towards the gripping sleeve.

35. A stabilizer according to claim 34 wherein the taper of the surface at the upper end of the sleeve differs from the taper of the surface at the lower end of the sleeve.

36. A stabilizer according to claim 35 wherein the taper at the upper end is greater than the taper at the lower end.

37. A clamp-on stabilizer comprising:

a tubular gripping sleeve for gripping around an object of interest, the sleeve having an upper end and a lower end each having an inwardly tapered exterior surface, a plurality of longitudinal slots at each end extending from the end toward the middle of the sleeve, and a slot extending from the lower end to the upper end;

a stabilizer body around the sleeve having an upper end and a lower end, the body being movable axially relative to the gripping sleeve;

rib means on the stabilizer body for contacting the gage of a borehole;

a first tapered surface axially fixed at the lower end of the stabilizer body for engaging the tapered lower end surface of the sleeve;

a second tapered surface for engaging the tapered upper end surface of the sleeve, the second tapered surface being axially movable relative to the stabilizer body; and means cooperating with the stabilizer body for axially displacing the second tapered surface toward the first tapered surface, so that, upon such displacement, engagement of the first and second tapered surfaces with the corresponding tapered surfaces on the gripping sleeve causes the gripping sleeve to tighten about the object of interest.

38. A clamp-on stabilizer according to claim 37 where the first tapered surface is integrally formed with the stabilizer body.

39. A clamp-on stabilizer according to claim 37 where the cooperating means comprises a tubular member having a threaded end for threaded engagement with a threaded portion of the upper end of the stabilizer body.

40. A clamp-on stabilizer according to claim 39 where the second tapered surface comprises a ring abutting the tubular member.

41. A clamp-on stabilizer according to claim 40 where threading of the tubular member with the stabilizer body causes the ring to be axially displaced toward the first tapered surface in the stabilizer body.

42. A clamp-on stabilizer according to claim 37 where the taper of the first surface is less than the taper of the second surface.

43. A clamp-on stabilizer according to claim 37 where the taper of the first surface is substantially the same as the taper of the second surface.

44. A clamp-on stabilizer comprising:

a tubular gripping sleeve for gripping around a drill string or the like, the sleeve having an upper end and a lower end and a plurality of longitudinal slots at each end;

a stabilizer body around the sleeve;

rib means on the stabilizer body for contacting the gage of a borehole;

means cooperating with the stabilizer body for inducing axial compression against the gripping sleeve upper and lower ends; and means for converting such axial compression into radial compression at the lower and upper ends of the gripping sleeve, the rate of conversion into radial compression being greater at the lower end than at the upper end, whereby the gripping sleeve tightens about a drill string or the like positioned inside the sleeve.

45. A stabilizer according to claim 44 wherein the cooperating means comprises a tubular member having a threaded lower end for threaded engagement with a threaded portion of an upper end of the stabilizer body.

46. A stabilizer according to claim 45 wherein the converting means comprises a first inwardly tapered external surface on the gripping sleeve upper end;

a second inwardly tapered external surface on the sleeve lower end, the first taper at the upper end being greater than the second taper at the lower end;

an axially displaceable ring abutting the tubular member and having a third interior tapered surface for engaging the first tapered surface on the gripping sleeve upper end; and a fourth internal tapered surface fixed in a lower end of the stabilizer body for engaging the second tapered surface on the gripping sleeve lower end.

47. A stabilizer according to claim 46 wherein the axially fixed fourth surface is integrally formed in the stabilizer body.

48. A stabilizer according to claim 46 wherein the angle of the first and third tapers is about twice the angle of the second and fourth tapers relative to the axis of the stabilizer.

49. A stabilizer according to claim 44 comprising a longitudinal slot in the gripping sleeve extending from the upper end of the sleeve to the lower end of the sleeve.

50. A clamp-on stabilizer comprising:

a tubular gripping sleeve for gripping around a drill string or the like, the sleeve having an upper end and a lower end and a plurality of radially deflectable fingers at each end;

a stabilizer body having an upper end and a lower end, the stabilizer body in use encasing the lower end of the sleeve;

rib means on the stabilizer body for contacting the gage of a borehole;

means cooperating with the stabilizer body upper end for inducing axial compression against the gripping sleeve upper and lower ends; and means for converting such axial compression into radial compression at the gripping sleeve lower and upper ends to radially tighten the fingers around the drill string or the like, so that the rate of radial deflection of the fingers is greater at the lower end than at the upper end.

51. A stabilizer according to claim 50 wherein the cooperating means comprises a tubular member having a threaded lower end for threaded engagement with a threaded portion of the upper end of the stabilizer body.

52. A stabilizer according to claim 50 wherein the converting means comprises a first inwardly tapered external surface on the fingers at the gripping sleeve upper end;

a second inwardly tapered external surface on the fingers at the sleeve lower end, the first taper at the upper end being greater than the second taper at the lower end;

an axially displaceable ring abutting the tubular member and having a third interior tapered surface for engaging the first tapered surface on the gripping sleeve upper end; and a fourth internal tapered surface fixed in the lower end of the stabilizer body for engaging the second tapered surface on the gripping sleeve lower end.

53. A stabilizer according to claim 52 wherein the axially fixed fourth surface is integrally formed in the stabilizer body.

54. A stabilizer according to claim 52 wherein the angle of the first and third tapers is about twice the angle of the second and fourth tapers relative to the axis of the stabilizer.

55. A stabilizer according to claim 50 where the fingers at one end of the gripping sleeve are longer than the fingers at the other end of the gripping sleeve.

56. A stabilizer according to claim 50 where the fingers at one end of the gripping sleeve have a smaller width than the fingers at the other end of the gripping sleeve.

57. A stabilizer according to claim 50 where the fingers at one end of the gripping sleeve are thinner in cross section than the fingers at the other end of the gripping sleeve.

58. A method for stabilizing the lateral position of a drill string or an object of interest on the drill string in a subterranean borehole, the method comprising:

placing a circumferentially compressible tubular sleeve about the object, such sleeve having inwardly tapered upper and lower ends, the taper at the lower end being less than the taper at the upper end;

axially engaging the tapers at the sleeve lower end and the upper end to circumferentially compress the sleeve sequentially at the lower and upper ends respectively about the object of interest; and displacing the sleeve laterally from the gage of the borehole to stabilize the lateral position of the object of interest.

59. A method according to claim 58 wherein the step of engaging comprises inducing progressive axial compression between the upper and lower ends of the gripping sleeve.

60. A method according to claim 59 wherein inducing progressive axial compression comprises threading a tubular member into a tubular body, the tubular body having a first internally tapered surface which engages the taper at the lower end of the sleeve, and wherein the tubular member presses a second internally tapered surface against the taper at the upper end of the sleeve.

61. A method according to claim 58 wherein the step of engaging comprises circumferentially compressing the full length of the sleeve from its upper end to its lower end about the object of interest.

62. A method according to claim 61 wherein the sleeve has a full-length longitudinal slot from the upper end to the lower end of the sleeve.

63. A method for stabilizing the lateral position of a drill string or the like in a subterranean borehole, the method comprising:

placing a radially deflectable tubular sleeve about the drill string, such sleeve having inwardly tapered upper and lower ends;

axially engaging the tapers at each end of the sleeve to radially tighten the sleeve about the drill string, the rate of radial tightening being greater at the lower end of the sleeve than at the upper end of the sleeve; and displacing the sleeve laterally from the gage of the borehole to stabilize the lateral position of the drill string.

64. A method according to claim 63 wherein the step of engaging comprises inducing progressive axial compression between the upper and lower ends of the gripping sleeve.

65. A method according to claim 64 wherein inducing progressive axial compression comprises threading a tubular member into a tubular body, the tubular body having a first internally tapered surface which engages the taper at the lower end of the sleeve, and wherein the tubular member presses a second internally tapered surface against the taper at the upper end of the sleeve.

66. A method according to claim 65 wherein the taper at the upper end of the sleeve differs from the taper at the lower end of the sleeve.

67. A method according to claim 65 wherein the upper and lower ends of the sleeve each comprise a plurality of longitudinal fingers.

68. A method according to claim 67 wherein the fingers at the lower end of the sleeve are longer than the fingers at the upper end of the sleeve.

69. A method according to claim 67 wherein the fingers at the lower end of the sleeve are narrower than the fingers at the upper end of the sleeve.

* * * * *